US010052776B2

(12) United States Patent
Provost et al.

(10) Patent No.: US 10,052,776 B2
(45) Date of Patent: Aug. 21, 2018

(54) SHAVING SYSTEMS

(71) Applicant: SHAVELOGIC, INC., Plano, TX (US)

(72) Inventors: Craig A. Provost, Boston, MA (US); William E. Tucker, Attleboro, MA (US); John W. Griffin, Moultonborough, NH (US)

(73) Assignee: SHAVELOGIC, INC., Dallas, TX (US)

( * ) Notice: Subject to any disclaimer, the term of this patent is extended or adjusted under 35 U.S.C. 154(b) by 140 days.

(21) Appl. No.: 15/298,457

(22) Filed: Oct. 20, 2016

(65) Prior Publication Data

US 2017/0036362 A1 Feb. 9, 2017

Related U.S. Application Data

(63) Continuation of application No. 13/929,340, filed on Jun. 27, 2013, now Pat. No. 9,486,930.

(60) Provisional application No. 61/706,523, filed on Sep. 27, 2012.

(51) Int. Cl.

| | |
|---|---|
| ***B26B 21/14*** | (2006.01) |
| ***B26B 21/52*** | (2006.01) |
| ***B26B 21/40*** | (2006.01) |
| ***B26B 21/22*** | (2006.01) |

(52) U.S. Cl.

CPC ..... *B26B 21/521* (2013.01); *B26B 21/14* (2013.01); *B26B 21/225* (2013.01); *B26B 21/4081* (2013.01); *Y10T 83/04* (2015.04)

(58) Field of Classification Search

CPC ..... B26B 21/14; B26B 21/521; B26B 21/225; B26B 21/4081; Y10T 83/04

USPC ..... 30/50

See application file for complete search history.

(56) References Cited

U.S. PATENT DOCUMENTS

| | | | | |
|---|---|---|---|---|
| 996,879 | A * | 7/1911 | odell | B26B 21/18 30/48 |
| 1,015,575 | A | 1/1912 | Meyer | |
| 1,074,615 | A | 10/1913 | Folmer | |
| 3,593,416 | A | 7/1971 | Edson | |
| 3,709,517 | A | 1/1973 | Wossner | |
| 3,768,348 | A | 10/1973 | Braun et al. | |
| 3,938,247 | A | 2/1976 | Carbonell et al. | |

(Continued)

FOREIGN PATENT DOCUMENTS

| | | |
|---|---|---|
| EP | 1245351 | 10/2002 |
| EP | 1488894 | 12/2004 |

(Continued)

OTHER PUBLICATIONS

Search Report—Corresponding European Patent Application No. 13840539, dated Apr. 25, 2016, 7 pages.

(Continued)

*Primary Examiner* — Sean Michalski

(74) *Attorney, Agent, or Firm* — Leber IP Law; Celia H. Leber

(57) ABSTRACT

Shaving assemblies are disclosed that include a blade unit, an interface element configured to connect the blade unit to a handle, on which the blade unit is pivotably mounted, and an return element disposed between the blade unit and interface element. The return element serves as interface piece, connector and pivot all in one. Shaving systems including such shaving assemblies are also disclosed, as are methods of using such shaving systems.

19 Claims, 18 Drawing Sheets

(56) References Cited

U.S. PATENT DOCUMENTS 4,094,063 A * 6/1978 Trotta ..... B26B 21/521 30/47
4,403,414 A 9/1983 Kiraly
4,475,286 A * 10/1984 Saito ..... B26B 21/225 30/50
4,774,765 A * 10/1988 Ferraro ..... B26B 21/227 30/50
4,785,534 A * 11/1988 Lazarchik ..... B26B 21/225 30/50
4,834,760 A * 5/1989 Richter, Jr. ..... A61F 2/588 294/104
4,838,564 A * 6/1989 Jarvis ..... A63C 17/064 280/11.225
4,850,518 A * 7/1989 Salmon ..... B62D 43/04 224/42.23
4,970,784 A * 11/1990 Althaus ..... B26B 21/225 30/50
5,029,391 A 7/1991 Althaus
5,074,042 A 12/1991 Althaus et al.
5,168,628 A 12/1992 Mock et al.
5,219,468 A 6/1993 Olson
5,369,885 A 12/1994 Ferraro
5,402,574 A 4/1995 Milner
5,466,901 A 11/1995 Mochizuki
5,533,263 A 7/1996 Gilder
5,551,153 A 9/1996 Simms
5,551,717 A 9/1996 De Courcey Milne
5,560,106 A 10/1996 Armbruster
5,645,603 A 7/1997 Peters
5,661,907 A 9/1997 Apprille
5,669,139 A 9/1997 Oldroyd et al.
5,678,316 A 10/1997 Althaus et al.
5,771,591 A 6/1998 Armbruster et al.
5,794,342 A 8/1998 Davey
5,813,293 A 9/1998 Apprille, Jr.
5,855,071 A 1/1999 Apprille et al.
5,890,296 A 4/1999 Metcalf
6,014,918 A * 1/2000 Orloff ..... B26B 21/405 30/34.05
6,112,412 A 9/2000 Richard
6,122,826 A * 9/2000 Coffin ..... B26B 21/521 30/527
6,138,361 A 10/2000 Follo
6,145,201 A 11/2000 Andrews
6,161,287 A * 12/2000 Swanson ..... B26B 21/225 30/47
6,182,366 B1 2/2001 Richard
6,216,345 B1 4/2001 Andrews
6,223,442 B1 * 5/2001 Pina ..... B26B 21/225 30/50
6,311,400 B1 * 11/2001 Hawes ..... B26B 21/225 30/50
6,357,118 B1 * 3/2002 Eichhorn ..... B26B 19/048 30/43.92
6,502,318 B1 * 1/2003 Gilder ..... B26B 21/225 30/50
6,557,265 B2 5/2003 Coffin
6,560,881 B2 5/2003 Coffin
6,612,040 B2 9/2003 Gilder
6,615,498 B1 9/2003 King
6,772,523 B1 8/2004 Richard
6,807,739 B2 10/2004 Follo
6,854,188 B1 2/2005 Wonderley
6,880,253 B1 4/2005 Gyllerstrom
6,973,730 B2 * 12/2005 Tomassetti ..... B26B 21/225 30/527
6,990,740 B2 1/2006 Follo
7,028,405 B2 4/2006 Paas et al.
7,086,160 B2 8/2006 Coffin
7,100,284 B2 9/2006 King
7,103,976 B2 9/2006 Pennella
7,152,512 B1 12/2006 Prochaska
7,200,942 B2 4/2007 Richard
7,461,458 B2 12/2008 Peyser
7,526,869 B2 5/2009 Blatter et al.
7,574,809 B2 8/2009 Follo
7,669,511 B2 3/2010 King
7,797,834 B2 9/2010 Steunenberg
7,802,368 B2 9/2010 Coffin et al.
7,877,879 B2 2/2011 Nakasuka
8,033,023 B2 10/2011 Johnson
8,096,054 B2 1/2012 Denkert
8,166,661 B2 5/2012 King
8,205,343 B2 6/2012 Winter
8,205,344 B2 * 6/2012 Stevens ..... B26B 21/521 30/526
8,273,205 B2 * 9/2012 Murgida ..... B26B 21/22 156/242
8,307,552 B1 11/2012 Drouillard
8,484,852 B2 7/2013 King
8,499,459 B2 8/2013 Efthimiadis et al.
8,590,162 B2 * 11/2013 Park ..... B26B 21/225 30/50
8,640,342 B2 2/2014 Murgida
8,732,955 B2 5/2014 Howell et al.
8,769,825 B2 7/2014 Howell et al.
8,789,282 B2 7/2014 Wilson et al.
8,793,880 B2 8/2014 Taub et al.
8,844,145 B2 9/2014 Psimadas et al.
9,283,685 B2 3/2016 Griffin
9,902,077 B2 2/2018 Park et al.
2002/0059729 A1 5/2002 Ikuta et al.
2002/0138992 A1 10/2002 Richard
2002/0157255 A1 10/2002 Coffin
2003/0046819 A1 3/2003 Ferraro
2003/0154603 A1 8/2003 Guimont et al.
2003/0200659 A1 10/2003 Coffin et al.
2003/0200660 A1 10/2003 Pennella et al.
2003/0205858 A1 11/2003 Hall
2004/0010918 A1 1/2004 Orloff et al.
2004/0177519 A1 9/2004 Tomassetti et al.
2005/0039338 A1 2/2005 King
2005/0207837 A1 9/2005 Kosh et al.
2005/0278954 A1 12/2005 Orloff et al.
2006/0037197 A1 2/2006 Hawes et al.
2006/0080837 A1 4/2006 Johnson et al.
2006/0080838 A1 4/2006 Johnson
2006/0283025 A1 12/2006 Follo et al.
2007/0151106 A1 7/2007 Steunenberg et al.
2007/0204932 A1 9/2007 Freed
2007/0289139 A1 12/2007 Peyser et al.
2008/0155831 A1 7/2008 Royle
2008/0189964 A1 8/2008 Bozikis
2008/0196251 A1 8/2008 Royle
2009/0000126 A1 1/2009 Kraus
2009/0038167 A1 2/2009 Peyser
2009/0235539 A1 9/2009 Wonderley
2010/0011583 A1 1/2010 Efthimiadis et al.
2010/0043242 A1 2/2010 Stevens
2010/0083505 A1 4/2010 Royle et al.
2011/0138586 A1 6/2011 Gompert et al.
2011/0192031 A1 8/2011 Coresh
2012/0060382 A1 3/2012 Beugels et al.
2012/0073554 A1 3/2012 Victor et al.
2012/0124840 A1 5/2012 Iaccarino et al.
2012/0210586 A1 8/2012 Lelieveld et al.
2013/0025578 A1 1/2013 Jones
2013/0081289 A1 4/2013 Wain et al.
2013/0174821 A1 7/2013 Jones
2014/0083265 A1 3/2014 Provost et al.
2014/0109735 A1 4/2014 Shepperson
2014/0165800 A1 6/2014 Griffin
2015/0158192 A1 6/2015 Tucker
2015/0174776 A1 6/2015 Hawes
2015/0190935 A1 7/2015 Griffin
2015/0190936 A1 7/2015 Griffin
2015/0290819 A1 10/2015 Giannopoulos
2015/0306777 A1 10/2015 Georgakis
2015/0314465 A1 11/2015 Giannopoulos

(56) References Cited

U.S. PATENT DOCUMENTS

| | | | |
|---|---|---|---|
| 2015/0314466 | A1 | 11/2015 | Papadopoulos-Papageorgis |
| 2015/0321366 | A1 | 11/2015 | Papadopoulos-Papageorgis |

FOREIGN PATENT DOCUMENTS

| | | |
|---|---|---|
| EP | 2123410 | 11/2009 |
| GB | 1460732 | 1/1977 |
| GB | 2030909 | 4/1980 |
| WO | 2006127435 | 11/2006 |
| WO | 2010022192 | 2/2010 |

OTHER PUBLICATIONS

International Search Report—Corresponding PCT Application No. PCT/US2013/052095, dated Oct. 15, 2013, 4 pages.

* cited by examiner

SHAVING SYSTEMS

RELATED APPLICATIONS

This application is a continuation application of U.S. patent application Ser. No. 13/929,340, filed Jun. 27, 2013, which claims priority of U.S. Provisional Application Ser. No. 61/706,523, filed on Sep. 27, 2012. The complete disclosure of these applications is hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

In general, the present disclosure pertains to shaving systems and to replaceable shaving assemblies for use in such systems. The systems include a flexible return element, e.g., of an elastomeric material, which provides the resistance and return force that are often provided by a pusher and follower mechanism in prior art shaving systems.

In one aspect, the invention features a replaceable shaving assembly that includes a blade unit and an interface element configured to removably connect the blade unit to a handle, on which the blade unit is pivotably mounted. The interface element includes spaced apart rigid portions connected by a flexible return element, the return element providing a pivoting connection between the blade element and handle.

Some implementations include one or more of the following features. A handle interface element configured to receive the handle may extend from one of the rigid portions, and a blade unit interface element configured to be mounted on the blade unit may extend from the other rigid portion. The return element may comprise two spaced apart elastomeric members that extend in a direction generally perpendicular to a longitudinal axis of the blade unit, and each of the elastomeric members may connect a pair of the spaced apart rigid portions. The return element may be configured to bias the blade unit towards a rest position with respect to a pivot axis that is generally parallel to a long axis of the blade unit, and is preferably pretensioned. The return element may be formed of an elastomeric material, e.g., a thermoplastic elastomer or thermoplastic urethane. The return element is generally molded onto the interface elements, e.g., by an overmolding process. In some cases, the return element includes two generally H-shaped portions. The rigid portions include corresponding protrusions, which extend toward each other and are embedded in the return element. In some cases, anchoring areas are provided in the protrusions, e.g., holes into which the elastomeric material of the return element can flow during overmolding.

In another aspect, the invention features a shaving system that includes a handle having a distal end and a proximal end, and a shaving assembly, mounted on the distal end of the handle, the shaving assembly including an interface element configured to connect the blade unit to the handle, and a blade unit that is pivotably mounted on the interface element. The interface element includes a pair of spaced apart rigid portions connected by a flexible return element, the return element providing a pivoting connection between the blade element and handle.

Some implementations of this aspect can include any one or more of the features discussed above with regard to the shaving assembly. In some cases, the shaving assembly is removably mounted on the handle via the interface element and is replaceable.

The invention also features methods of shaving. For example, in one aspect the invention features a method of shaving comprising contacting the skin with the blade unit of a shaving system comprising a handle having a distal end and a proximal end, and a replaceable shaving assembly that includes a blade unit, and an interface element configured to removeably connect the blade unit to a handle, on which the blade unit is pivotably mounted, the interface element comprising a pair of spaced apart rigid portions connected by an elastomeric element, the elastomeric element providing a pivoting connection between the blade element and handle.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit, which includes a return element. For example, the present disclosure could include a system having a blade unit attached to a handle in part by elongated elastomeric members that provide the resistance and return force usually supplied by a pusher/follower assembly.

Figure 1:
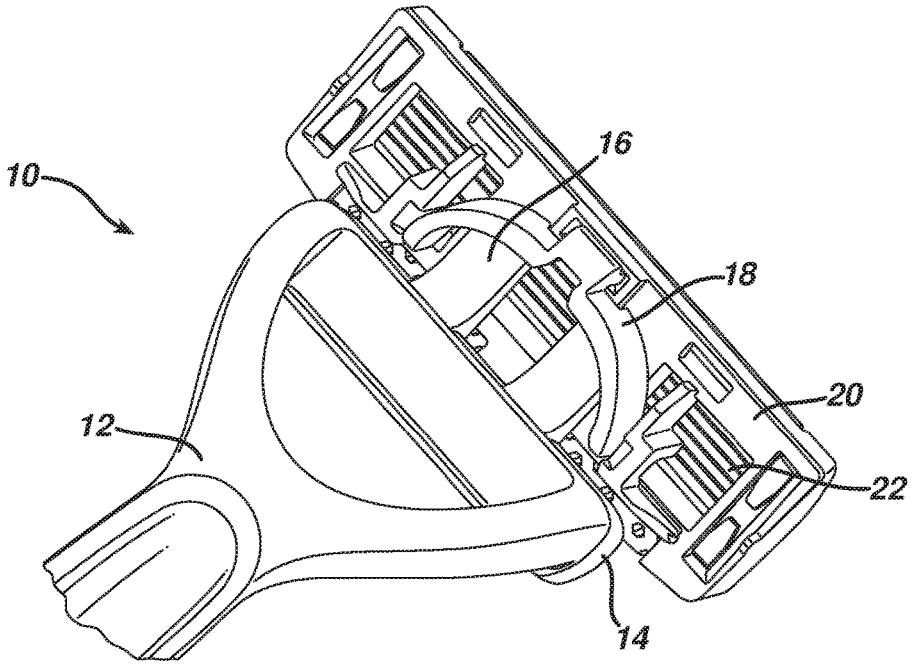
FIG. 1 is a perspective view of an assembled shaving system according to one embodiment.
Figure 2:
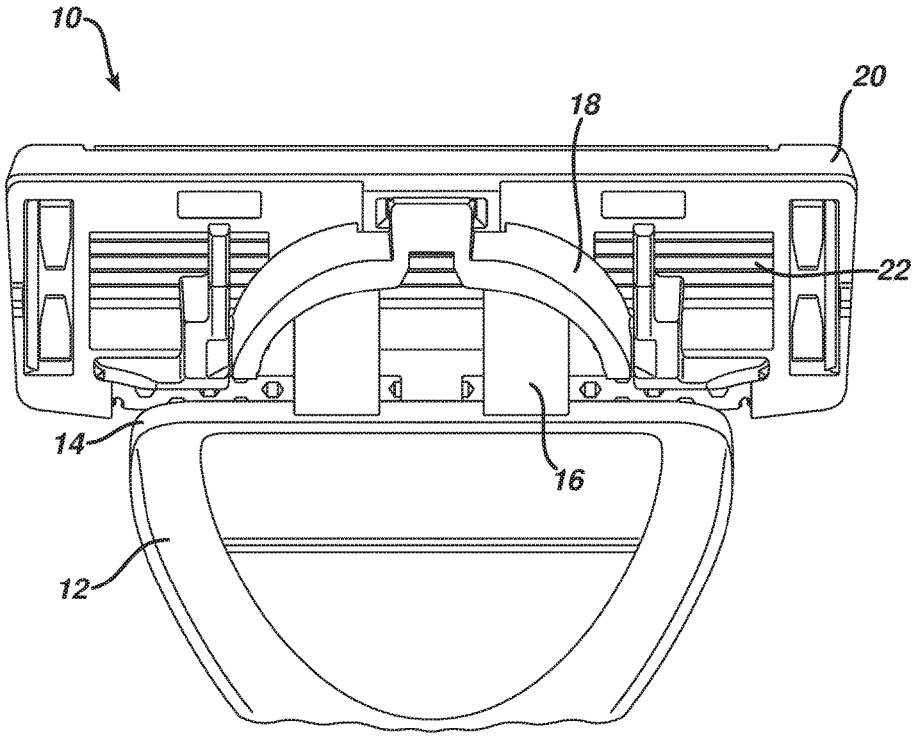
FIG. 2 is a rear plan view of the assembled shaving system.
Figure 3:
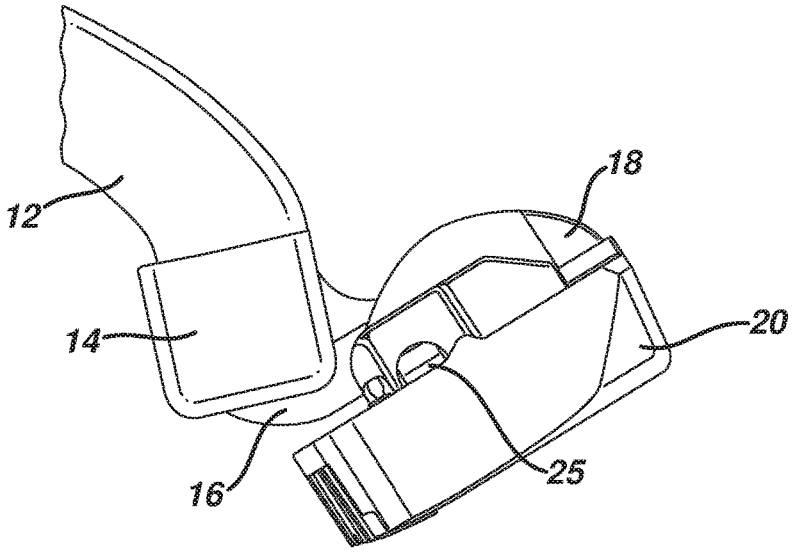
FIG. 3 is a side plan view of the assembled shaving system.
Figure 13:
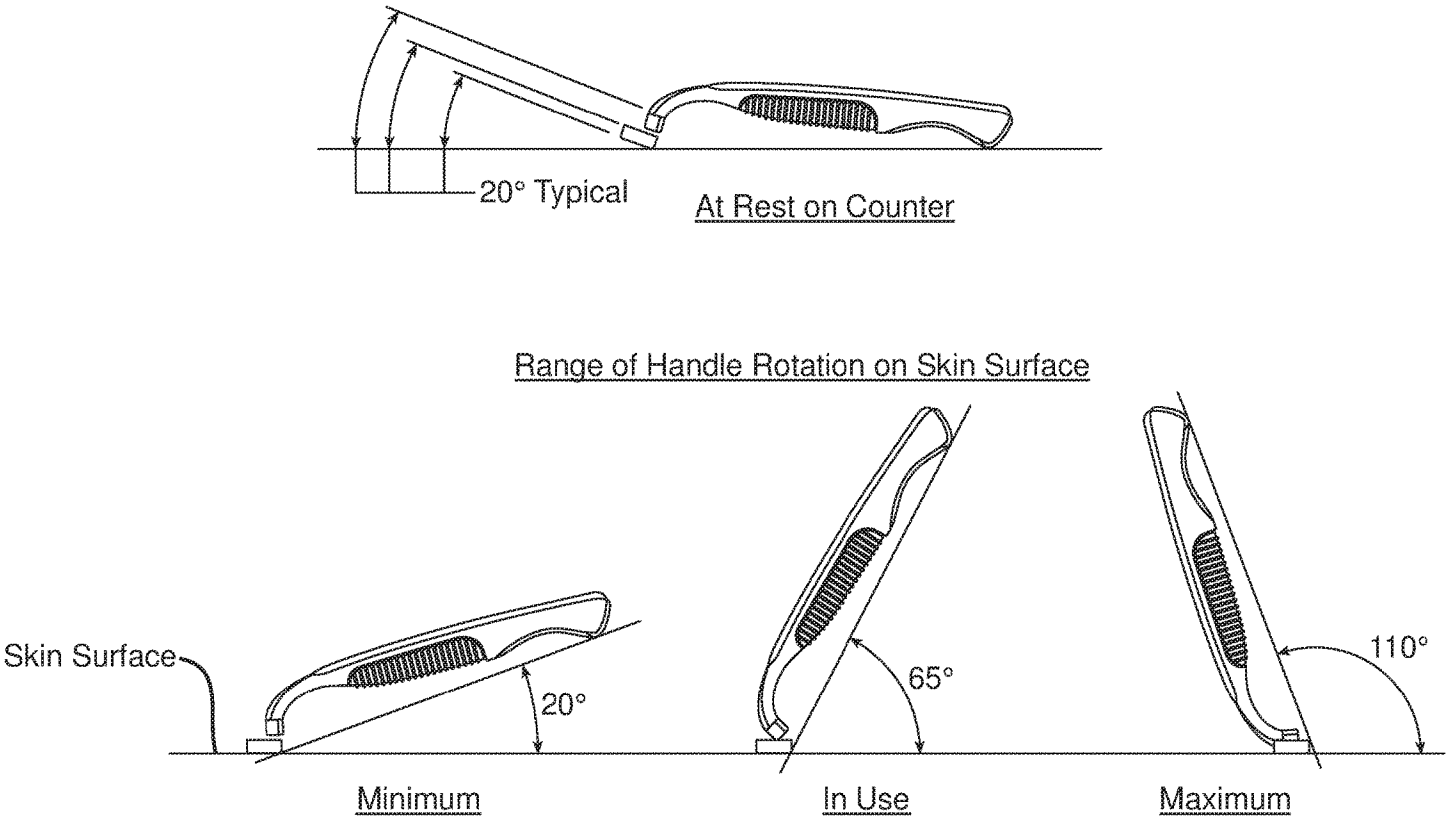
FIG. 13 is a series of diagrammatic views illustrating how the angle of the blade unit with respect to the handle is measured.

FIG. 1 shows a shaving system 10 that includes a handle 12, a handle interface element 14, a return element 16, a blade unit interface element 18 and a blade unit 20 which includes a plurality of blades 22. Pivoting of the blade unit 20 is about an axis that is generally parallel to the long axis of the blade unit and is generally positioned to allow the blade unit 20 to follow the contours of a user's skin during shaving. Generally, the handle interface element 14, the return element 16, the blade unit interface element 18 and blade unit 20 are sold to the consumer as an integrated replaceable shaving assembly. Preferably the angle of blade unit 20 with respect to handle 12 is 65° but can range from approximately 15° to 105° (FIG. 13).

Figure 4:
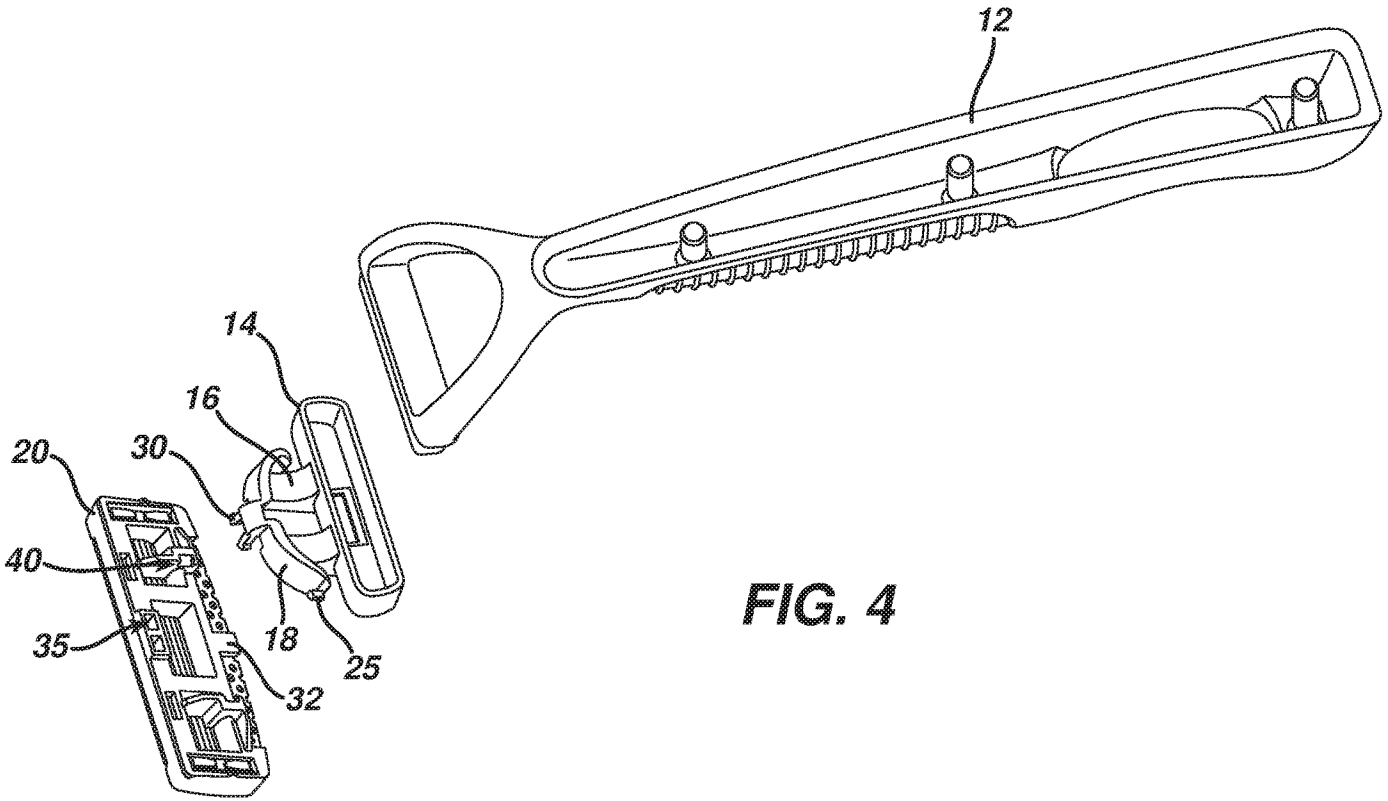
FIG. 4 is an exploded view of the shaving system.

Referring to FIG. 4, the blade unit 20 is mounted on blade unit interface element 18 by the positioning of a pair of fingers 30 which extend from the blade unit interface element 18 into receiving bores 35 on the blade unit 20. The receiving bores 35 may be molded integrally with the blade unit 20. In addition, the blade unit interface element 18 includes tabs 25A and 25B (FIG. 6) that serve as complementary attachment points for the blade unit 20. The blade unit pivot stop 32 is integrally formed with the blade unit 20 and extends generally perpendicular to the long axis of the blade unit 20. The blade unit pivot stop 32 limits the pivoting of the blade unit 20.

Figure 5:
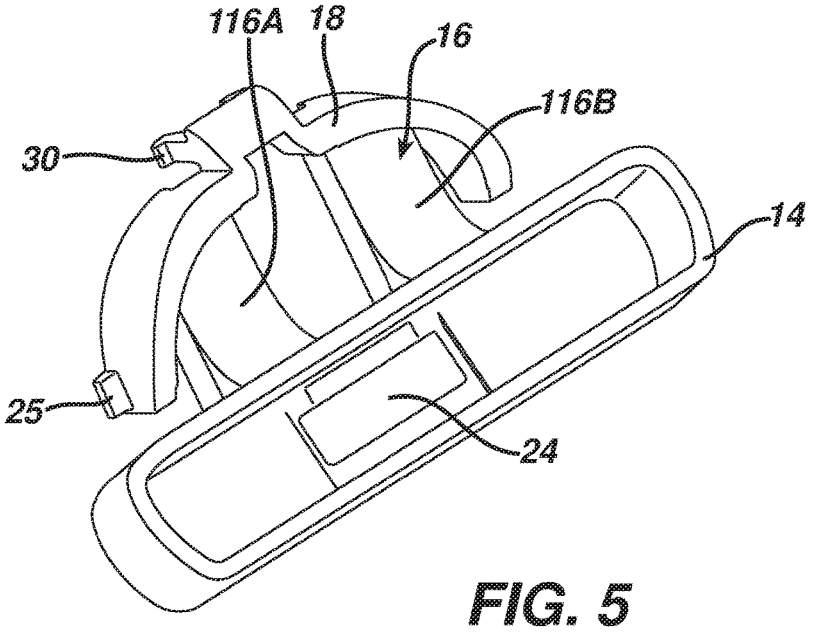
FIG. 5 is a view of the handle interface element, the return element, and the blade unit interface element of the shaving system shown in FIG. 1.
Figure 5A:
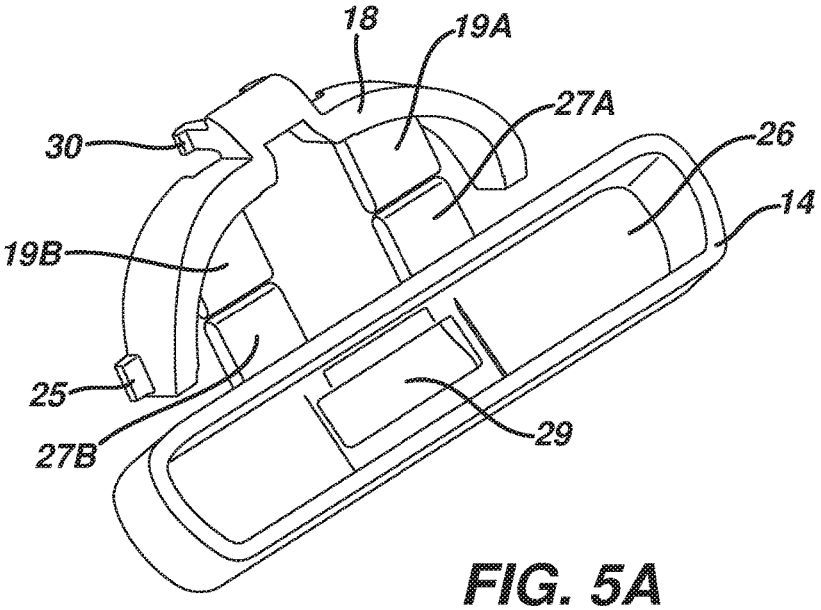
FIG. 5A is a view of the handle interface element and the blade interface element.

Referring to FIG. 5A, the handle interface element 14 is made up of a handle interface portion 26 and two protrusions 27A and 27B. The protrusions 27A and 27B extend generally perpendicular to the long axis of the handle interface portion 26. The blade unit interface element 18 has two protrusions 19A and 19B that correspond to and align in a similar plane as the two protrusions 27A and 27B on the handle interface portion 26.

Figure 6:
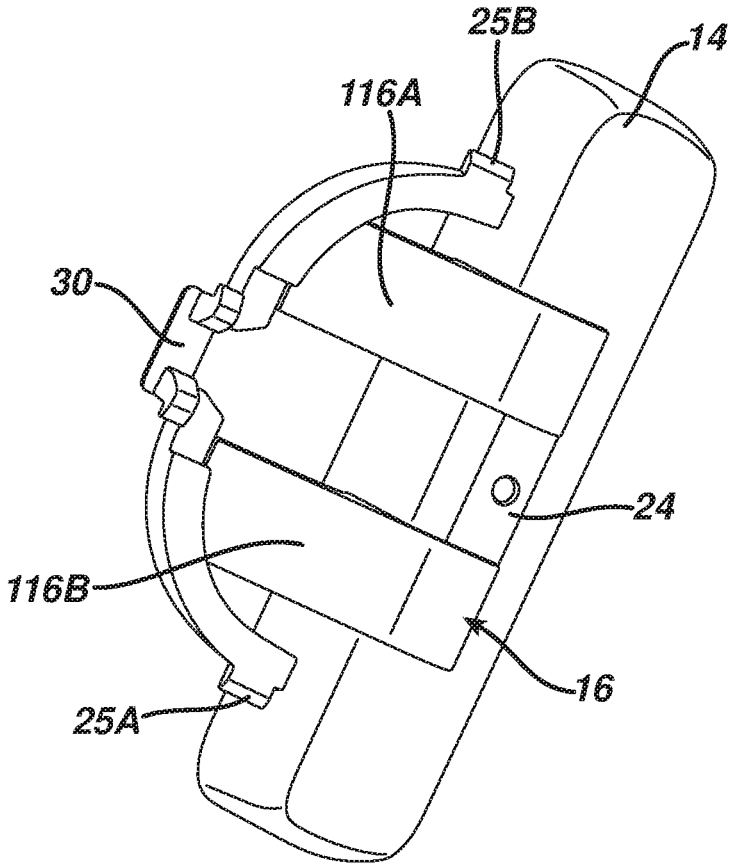
FIG. 6 is a perspective view of the handle interface element, the return element, and the blade unit interface element.
Figure 7:
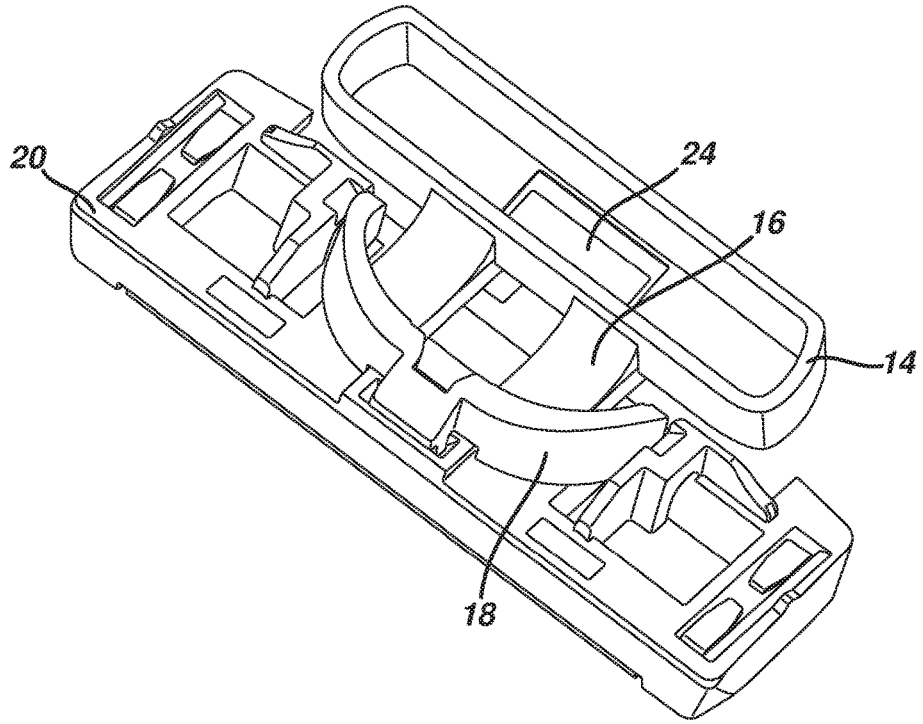
FIGS. 7 and 8 are alternate views of the handle interface element, the return element, the blade unit interface element, and the blade unit housing.

Referring to FIGS. 5-7, the handle interface element 14 is flexibly joined to the blade unit interface element 18 by the return element 16. The return element 16 consists of a pair of elongated elastomeric members 116A and 116B, which connect protrusions 19A and 19B to protrusions 27A and 27B. The return element 16 serves as a pivot and provides resistance during shaving, limiting the free pivoting of the blade unit about the pivot axis described above. In addition, the return element 16 provides a return force that biases the blade unit 16 towards its rest position, in the same manner that resistance and return force are typically provided by a pusher/follower assembly.

Figure 8:
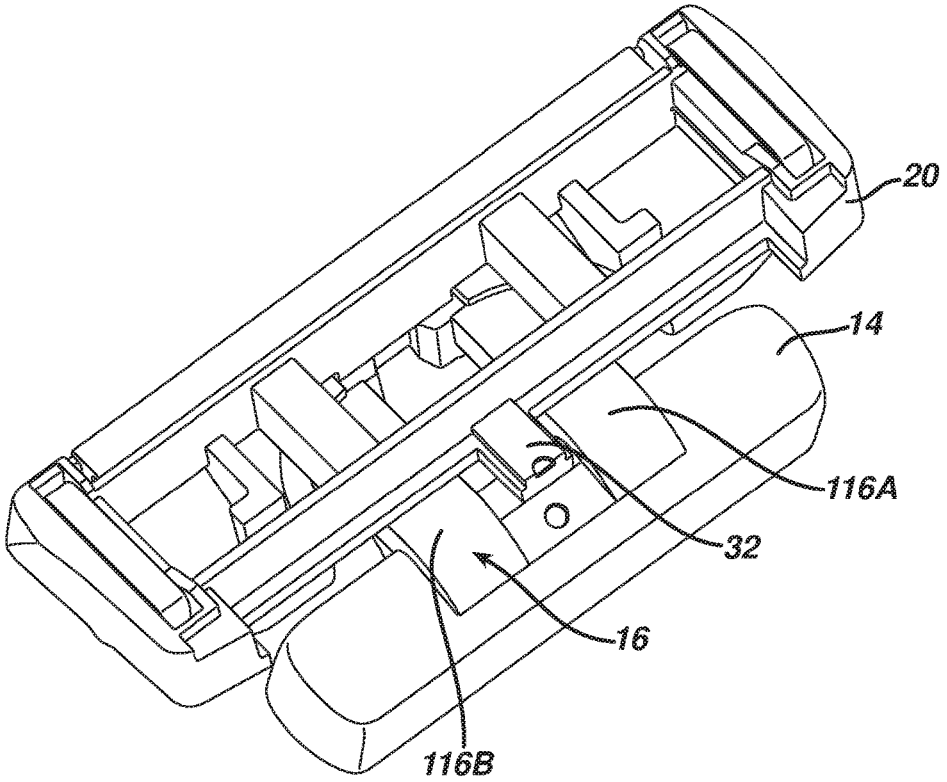
Figure 9:
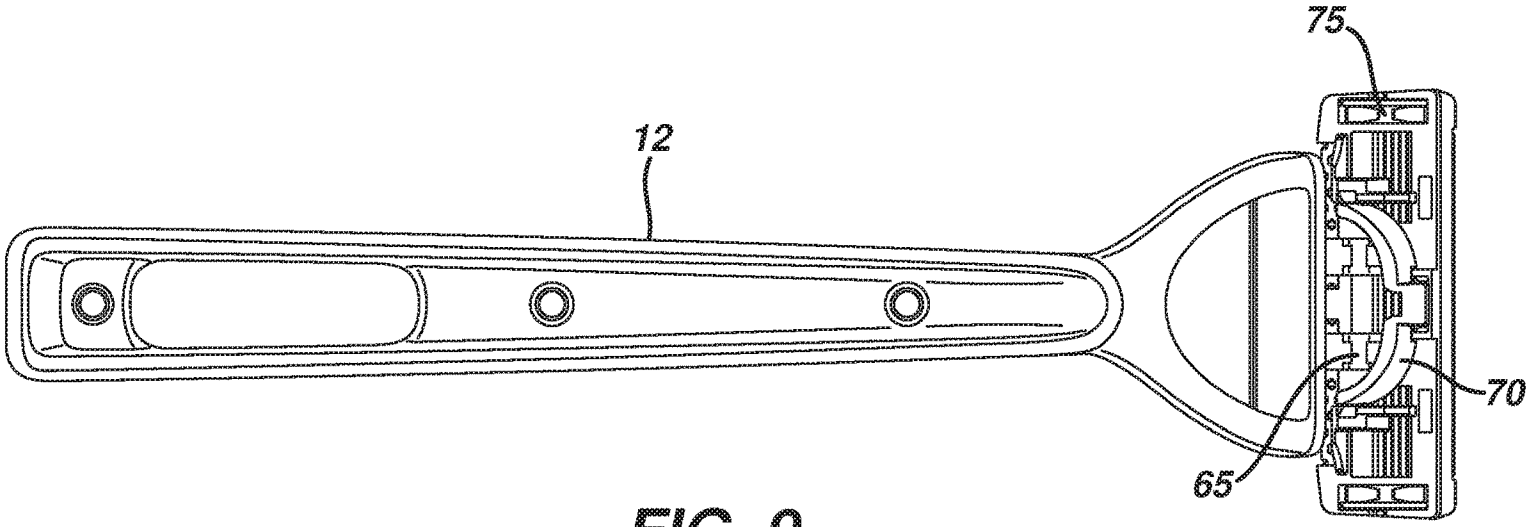
FIG. 9 is a perspective view of a shaving system according to an alternate embodiment.
Figure 10:
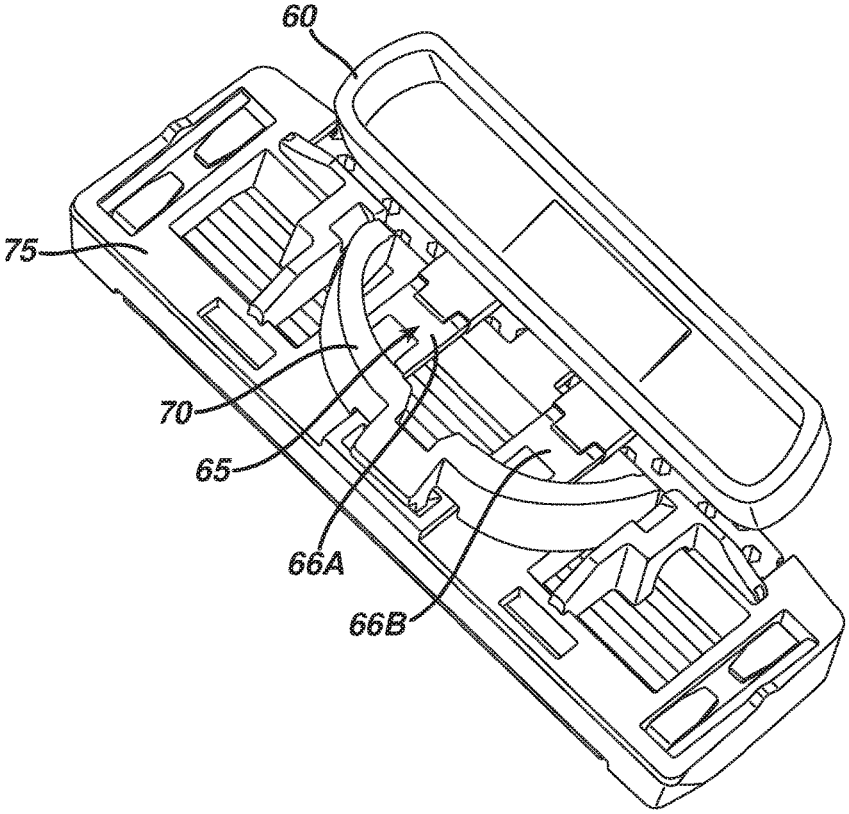
FIGS. 10 and 10A are enlarged perspective views of the handle interface element, the return element, the blade unit interface element, and the blade unit of the shaving system shown in FIG. 9.
Figure 10A:
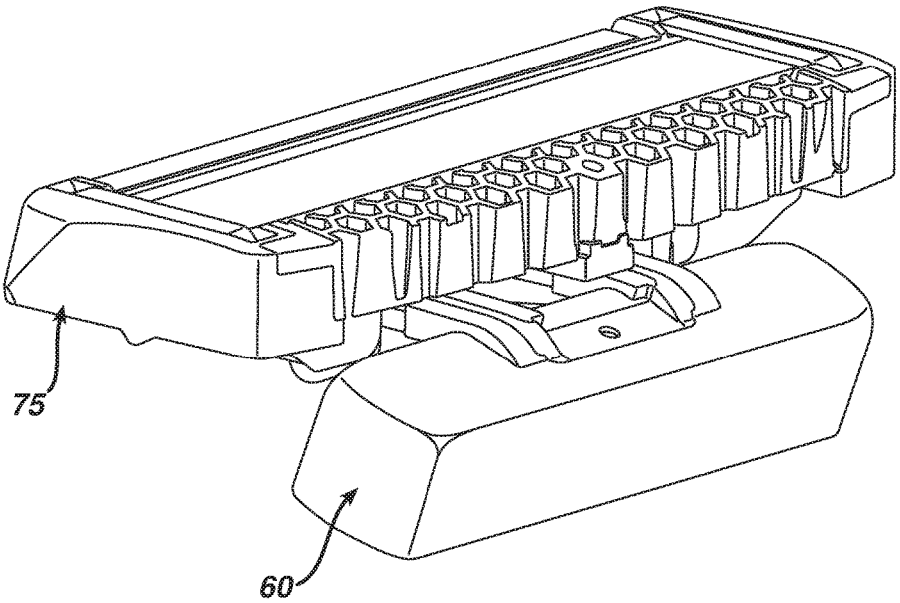
Figure 11:
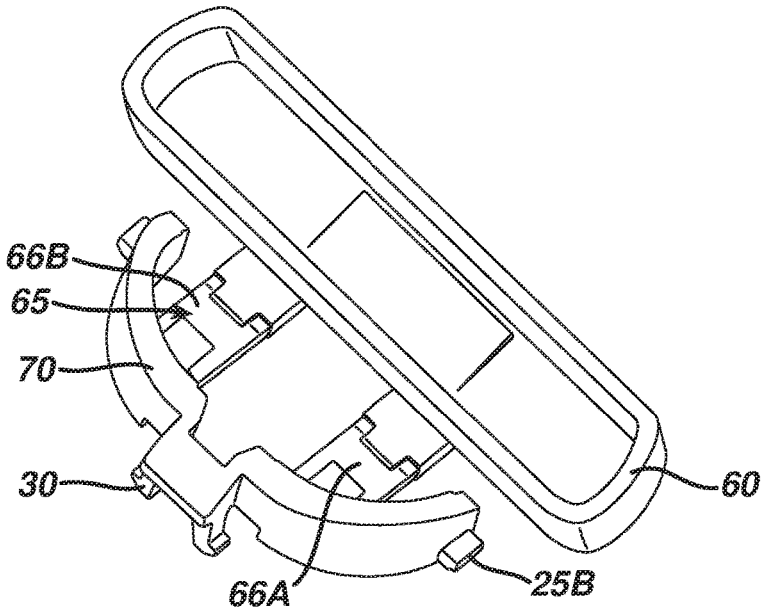
FIG. 11 is a perspective view of the handle interface element, the return element, and the blade unit interface element.
Figure 11A:
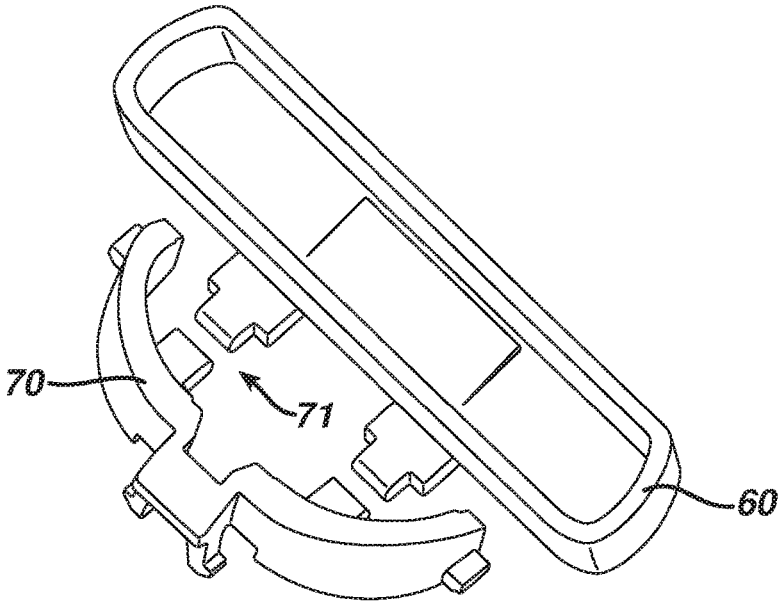
FIG. 11A is a view of the handle interface element and blade interface element.

Referring to FIG. 8, the elongated members 116A and 116B are pretensioned when the blade unit is in its at rest position by bending of the elastomer over the blade unit. This pretensioning is the result of the angle at which the components are molded and the geometry of the return element, which are selected so that when the interface element is assembled onto the blade unit the return element is pretensioned. Pretensioning provides a resistance force so that a load is applied as soon as the user starts shaving, balancing the blade unit.

Figure 5B:
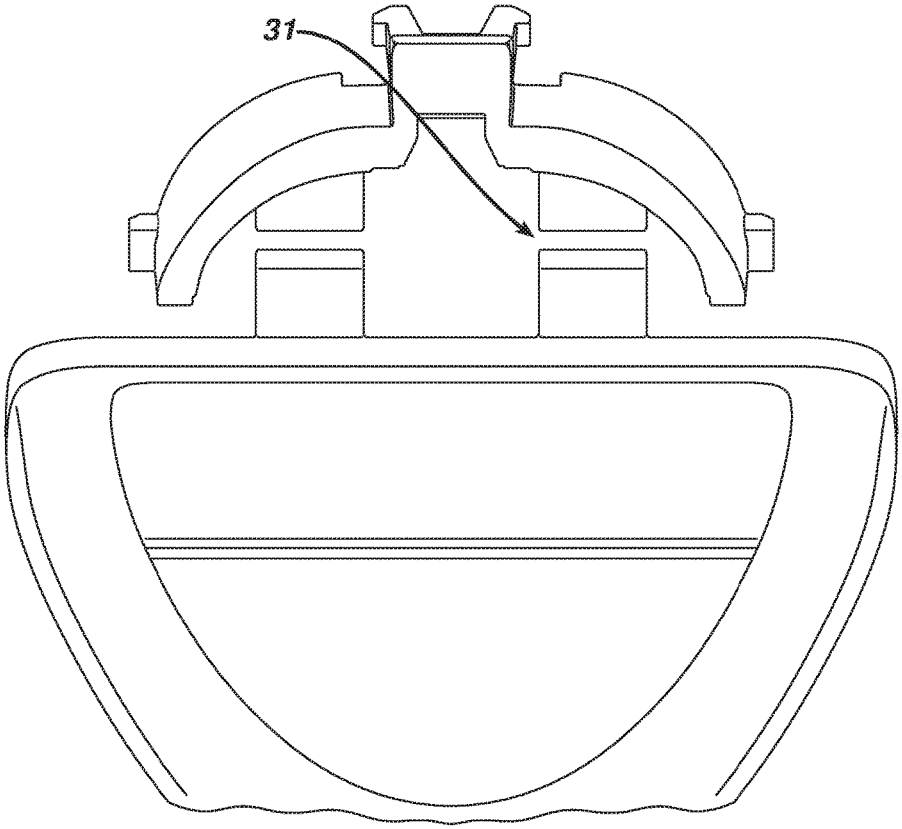
FIG. 5B is a perspective view of the handle interface element, blade interface element, and handle, with the return element omitted to show the spacing between the handle interface element and blade interface element.

The return element 16 may be integrally molded with the handle interface element 14 and the blade unit interface element 18, e.g., by co-molding the elastomer with the rigid plastic(s). It is noted that the term "co-molding," as used herein, includes transfer molding and other techniques suitable for molding two or more different materials into a single part. Molding is facilitated by an opening 29 in the handle interface element 14 through which the elastomeric material can be injected so that it molds around the protrusions 27A and 27B shown in FIG. 5A. Preferably, during co-molding, there is a gap 31 (FIG. 5B) between the blade unit interface element 18 and the handle interface element 14. This gap allows the two interface elements to be flexibly joined by the elastomer. In some implementations the gap is from about 1 mm to 15 mm, preferably about 3 to 10 mm. Molding the return element 16 in this manner results in an elastomeric anchor 24, which fills the opening 29. Thus, molding may be a three-shot process in which the interface elements are molded first in two separate shots, followed by the elastomer.

The return element 16 can be formed, for example, from synthetic or natural rubber materials. Suitable materials are well known in the shaving system art, and include thermoplastic elastomers, for example, polyether-based thermoplastic elastomers (TPEs) available from Kraiburg HTP, thermoplastic urethanes (TPUs), silicones, polyether-based thermoplastic vulcanizate elastomer (TPVs) available from GLS PolyOne Corporation under the tradename Santoprene™. The elastomeric material is selected to provide a desired degree of restoring force and durability. In some implementations, the elastomer has a Durometer of less than about 90 Shore A, e.g., from about 18 to 80 Shore A, preferably from about 30 to 60 Shore A.

The return element 16 is designed such that its geometry provides an applied load as assembled that is sufficient to overcome the friction of the system at rest (pretensioned load), typically at least 5 grams, e.g., 5 to 30 grams, and a load during shaving of from about 10 to 100 grams.

The handle 12 provides a manner in which the shaving system can be manipulated and leverage can be applied to achieve desired shaving results. Referring to FIG. 4, the handle 12 can be designed to interface with the handle interface element 14 in such a manner that would enable easy removal and attachment. This could be accomplished in a number of manners, such as a mechanical locking mechanism, magnetic interaction, etc. For example, the handle interface element 14 and handle 12 can interface in the manner discussed in U.S. Ser. No. 61/651,732, filed May 25, 2012, the full disclosure of which is incorporated herein by reference.

The handle 12, blade unit 20, blade interface element 18, and handle interface element 14 can be made of any suitable material including, for example, polyethylene terephthalate (PET or PETE), high density (HD) PETE, thermoplastic polymer, polypropylene, oriented polypropylene, polyurethane, polyvinyl chloride (PVC), polytetrafluoroethylene (PTFE), polyester, high-gloss polyester, metal, synthetic rubber, natural rubber, silicone, nylon, polymer, antibacterial or antimicrobial materials, insulating, thermal, or other suitable sustainable or biodegradable materials, or any combination thereof.

Figure 12:
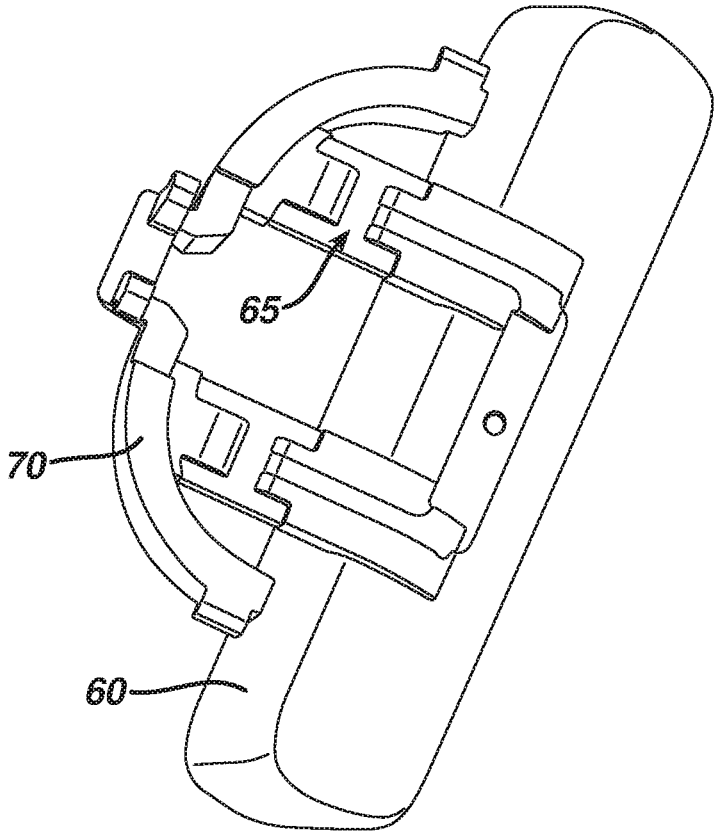
FIG. 12 is a perspective view of the handle interface element, the blade unit interface element, and the return element, taken from the opposite side.

FIGS. 9-12 show a shaving system 55 according to another embodiment. In this embodiment, the return element 65 includes a pair of elastomeric members 66A, 66B each of which is formed in the shape of an "H." As was the case in the embodiment shown in FIG. 1, the return element 65 provides an interface piece, connector and pivot all in one. The other aspects of the return element 65, the handle interface element 60, the blade unit interface element 70, the gap 71, and the blade unit 75 are the same as those in the embodiment mentioned previously. As discussed above, the elastomer may be co-molded with, or over-molded onto, the blade unit interface element and handle interface element. The flow path 141 of the elastomer is shown in FIG. 12.

Figure 14:
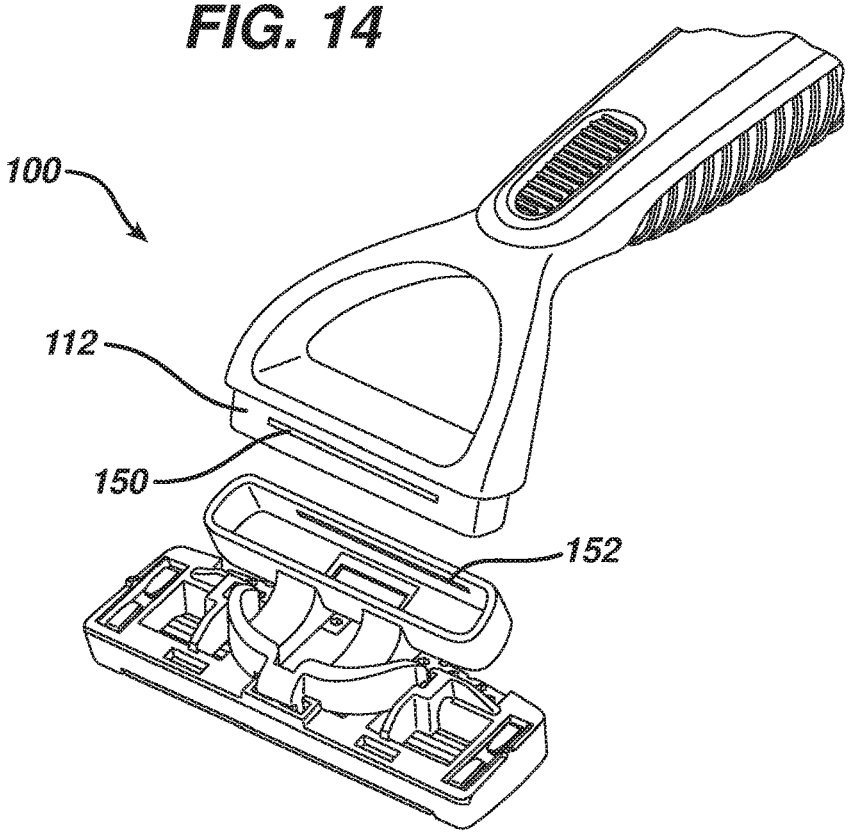
FIG. 14-14A are perspective views of an embodiment in which the shaving assembly is designed to be permanently attached to the handle.
Figure 14A:
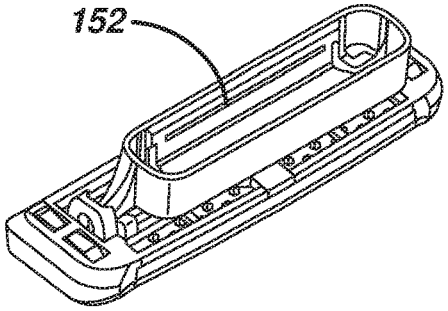

Also, while removable shaving assemblies have been discussed above, in some implementations the shaving system is designed to be disposable as a whole. In these cases, the shaving assembly is affixed to the handle in a manner that is not intended for the consumer to remove, e.g., by fixedly mounting the interface element on the distal end of the handle. This may be accomplished, for example, by engagement of corresponding mechanical locking features on the handle and interface element 144, by welding (e.g., ultrasonic welding), by molding the interface element integrally with the handle, or by any other desired mounting technique. An example of a disposable shaving system 100 is shown in FIG. 14, and the shaving assembly for such a system is shown in FIG. 14A. In this case, the handle 112 includes protrusions 150 (only one of which is shown, the other being on the opposite side of the handle), and the interface element includes corresponding locking indentations 152.

A number of embodiments have been described. Nevertheless, it will be understood that various modifications may be made without departing from the spirit and scope of the disclosure.

For example, in some embodiments through holes are provided in the portions of the interface elements over which the elastomer is molded. These holes extend in the direction of mold action, so that the elastomer will flow through the holes thereby anchoring the elastomer in place on the underlying interface elements. Alternatively, other anchoring techniques can be used.

Accordingly, other embodiments are within the scope of the following claims.

What is claimed is:

1. A replaceable shaving assembly comprising:

a blade unit; and an interface element, configured to removeably connect the blade unit to a handle, the interface element comprising (a) a handle interface portion, having a body configured to receive a distal end of the handle and a first pair of spaced apart rigid protrusions extending from the body, the rigid protrusions having longitudinal axes that extend generally perpendicular to a longitudinal axis of the blade unit, (b) a blade unit interface portion including a second pair of spaced apart rigid protrusions, wherein ends of the first and second pairs of rigid protrusions are positioned facing each other in opposed spaced relation such that longitudinal axes of the second pair of rigid protrusions are generally collinear with the longitudinal axes of the first pair of rigid protrusions, and the interface element further comprises (c) a pair of flexible elastomeric return elements, each return element joining the opposed ends of the rigid protrusions and thus flexibly joining the handle interface portion to the blade unit interface portion.

2. The shaving assembly of claim 1 wherein the blade interface portion further includes arms extending to distal ends on which the blade unit is pivotably mounted.

3. The shaving assembly of claim 1 wherein longitudinal axes of the return elements extend in a direction generally perpendicular to a longitudinal axis of the blade unit.

4. The shaving assembly of claim 1, wherein the return elements are configured to bias the blade unit towards a rest position with respect to a pivot axis that is generally parallel to the longitudinal axis of the blade unit.

5. The shaving assembly of claim 1, wherein the return elements are pretensioned such that the return elements exert a force on the blade unit at rest of at least 5 grams.

6. The shaving assembly of claim 1, wherein the return elements comprise a thermoplastic elastomer or thermoplastic urethane.

7. The shaving assembly of claim 1 wherein the return elements encapsulate the opposed rigid protrusions.

8. The shaving assembly of claim 1 wherein the return elements comprise H-shaped elastomeric members that join the opposed rigid protrusions.

9. The shaving assembly of claim 1 wherein the return elements are formed of an elastomer having a durometer of about 30 to 60 Shore A.

10. A shaving system comprising:

a handle having a distal end and a proximal end; and a shaving assembly, mounted on the distal end of the handle, the shaving assembly including an interface element configured to connect the blade unit to the handle, and a blade unit, the interface element comprising (a) a handle interface portion, having a body configured to receive a distal end of the handle and a first pair of spaced apart rigid protrusions extending from the body, the rigid protrusions having longitudinal axes that extend generally perpendicular to a longitudinal axis of the blade unit, (b) a blade unit interface portion including a second pair of spaced apart rigid protrusions, wherein ends of the first and second pairs of rigid protrusions are positioned facing each other in opposed spaced relation such that longitudinal axes of the second pair of rigid protrusions are generally collinear with the longitudinal axes of the first pair of rigid protrusions, and the interface element further comprises (c) a pair of flexible elastomeric return elements, each return element joining the opposed ends of the rigid protrusions and thus flexibly joining the handle interface portion to the blade unit interface portion.

11. The shaving system of claim 10 wherein the blade interface portion further includes arms extending to distal ends on which the blade unit is pivotably mounted.

12. The shaving system of claim 10 wherein longitudinal axes of the return elements extend in a direction generally perpendicular to a longitudinal axis of the blade unit.

13. The shaving system of claim 10, wherein the return elements are configured to bias the blade unit towards a rest position with respect to a pivot axis that is generally parallel to the longitudinal axis of the blade unit.

14. The shaving system of claim 10, wherein the return elements are pretensioned such that the return elements exert a force on the blade unit at rest of at least 5 grams.

15. The shaving system of claim 10, wherein the return elements comprise a thermoplastic elastomer or thermoplastic urethane.

16. The shaving system of claim 10 wherein the return elements encapsulate the opposed rigid protrusions.

17. The shaving system of claim 10 wherein the return elements comprise H-shaped elastomeric members that join the opposed rigid protrusions.

18. The shaving system of claim 10 wherein the return elements are formed of an elastomer having a durometer of about 30 to 60 Shore A.

19. A method of shaving comprising contacting the skin with the blade unit of a shaving system comprising a handle having a distal end and a proximal end, and a replaceable shaving assembly that includes a blade unit, and an interface element configured to connect the blade unit to a handle, the interface element comprising (a) a handle interface portion, having a body configured to receive a distal end of the handle and a first pair of spaced apart rigid protrusions extending from the body, the rigid protrusions having longitudinal axes that extend generally perpendicular to a longitudinal axis of the blade unit, (b) a blade unit interface portion including a second pair of spaced apart rigid protrusions, wherein ends of the first and second pairs of rigid protrusions are positioned facing each other in opposed spaced relation such that longitudinal axes of the second pair of rigid protrusions are generally collinear with the longitudinal axes of the first pair of rigid protrusions, and the interface element further comprises (c) a pair of flexible elastomeric return elements, each return element joining the opposed ends of the rigid protrusions and thus flexibly joining the handle interface portion to the blade unit interface portion.

* * * * *